US010175616B2

(12) United States Patent
Kikuchi

(10) Patent No.: US 10,175,616 B2
(45) Date of Patent: Jan. 8, 2019

(54) FIXING DEVICE INCLUDING COLLECTING PART COLLECTING IMPURITIES OF MEDIUM AND IMAGE FORMING APPARATUS INCLUDING THIS FIXING DEVICE

(71) Applicant: KYOCERA Document Solutions Inc., Osaka (JP)

(72) Inventor: Einosuke Kikuchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/869,143

(22) Filed: Jan. 12, 2018

(65) Prior Publication Data

US 2018/0217532 A1 Aug. 2, 2018

(30) Foreign Application Priority Data

Jan. 31, 2017 (JP) ..... 2017-015558

(51) Int. Cl.
*G03G 15/20* (2006.01)

(52) U.S. Cl.
CPC ..... *G03G 15/2025* (2013.01); *G03G 15/2053* (2013.01)

(58) Field of Classification Search
CPC ..... G03G 15/2025; G03G 15/2075; H05B 1/0241; H05B 3/0066
USPC ..... 399/327; 219/216
See application file for complete search history.

(56) References Cited

U.S. PATENT DOCUMENTS 4,253,008 A * 2/1981 Dolan ..... G03G 15/2064 219/216
4,935,785 A * 6/1990 Wildi ..... G03G 15/2057 399/171
7,389,077 B2 * 6/2008 Berkes ..... G03G 15/2053 399/324
2006/0062611 A1 * 3/2006 Ohishi ..... G03G 15/2028 399/328
2012/0155938 A1 * 6/2012 Tanaka ..... G03G 15/2075 399/335

(Continued)

FOREIGN PATENT DOCUMENTS

JP 60260978 A * 12/1985
JP 04109279 A * 4/1992
JP 09311572 A * 12/1997

(Continued)

*Primary Examiner* — Robert B Beatty
(74) *Attorney, Agent, or Firm* — Studebaker & Brackett PC

(57) ABSTRACT

A fixing device includes a heating body, a pressuring body, a charging part and a collecting part. The heating body contacts with a medium having a toner image while rotating to heat the medium. The pressuring body forms a nip with the heating roller while rotating to pressure the medium passing through the nip with the heating body. The charging part is positioned to face to the heating body and electrically discharges to electrically charge the heating body with the same polarity as polarity of toner. The collecting part is positioned to face to a position at an upstream side with respect to a facing position on the heating body to the charging part and at a downstream side with respect to a forming position of the nip in a rotating direction of the heating body, and collects impurities caused by the medium passing the nip by absorbing or removing.

8 Claims, 12 Drawing Sheets

(56) References Cited

U.S. PATENT DOCUMENTS

| | | | | |
|---|---|---|---|---|
| 2018/0032011 | A1* | 2/2018 | Nanjo | G03G 15/2064 |
| 2018/0173152 | A1* | 6/2018 | Nakajima | G03G 15/2025 |

FOREIGN PATENT DOCUMENTS

| | | | | |
|---|---|---|---|---|
| JP | 2000-305388 | A | | 11/2000 |
| JP | 2000305388 | A | * | 11/2000 |
| JP | 2007212840 | A | * | 8/2007 |
| JP | 2007292958 | A | * | 11/2007 |

* cited by examiner

FIXING DEVICE INCLUDING COLLECTING PART COLLECTING IMPURITIES OF MEDIUM AND IMAGE FORMING APPARATUS INCLUDING THIS FIXING DEVICE

INCORPORATION BY REFERENCE

This application is based on and claims the benefit of priority from Japanese Patent application No. 2017-015558 filed on Jan. 31, 2017, the entire contents of which are incorporated herein by reference.

BACKGROUND

The present disclosure relates to a fixing device and an image forming apparatus.

For example, a fixing device including a rotating body having a heating source and a pressuring member forming a pressure contact part in cooperation with a surface of the rotating body is known to make the pressure contact part sandwich and convey a recording material and to thermally fix a toner image electrostatically adhered and formed on a surface of the recording material onto the recording material. Moreover, in the fixing device, a charging means (a corotron charger) electrically charging the surface of the rotating body with the same polarity as that of a toner is provided. The charging means provided in the fixing device restrains occurrence of electrostatic offset.

Incidentally, in the above-mentioned fixing device, for example, when the rotating body and a pressing member heat and pressure a medium having the formed toner image to fix the toner image on the medium, impurities (e.g., the toner, materials constituting the toner, gases generated from those) caused by the medium may be adhered to the charging means. As a result, it is feared that electrical discharge with respect to the rotating body (in the axial direction) by the charging means becomes non-uniformity, and then, a discharging state is destabilized on a long-term basis. Further, this may lead to fixing failure.

SUMMARY

In accordance with the present disclosure, a fixing device includes a heating body, a pressuring body, a charging part and a collecting part. The heating body comes into contact with a medium, on which a toner image is formed, while rotating to heat the medium. The pressuring body forms a nip in cooperation with the heating roller while rotating to pressure the medium passing through the nip in cooperation with the heating body. The charging part is positioned to face to the heating body and electrically discharges to electrically charge the heating body with the same polarity as polarity of toner. The collecting part is positioned to face to a position at an upstream side with respect to a facing position on the heating body to the charging part and at a downstream side with respect to a forming position of the nip in a rotating direction of the heating body, and collects impurities caused by the medium passing the nip by absorbing or removing.

In accordance with the present disclosure, an image forming apparatus includes a forming part forming a toner image onto a medium and the above-described fixing device fixing the toner image formed on the medium by the forming part onto the medium.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
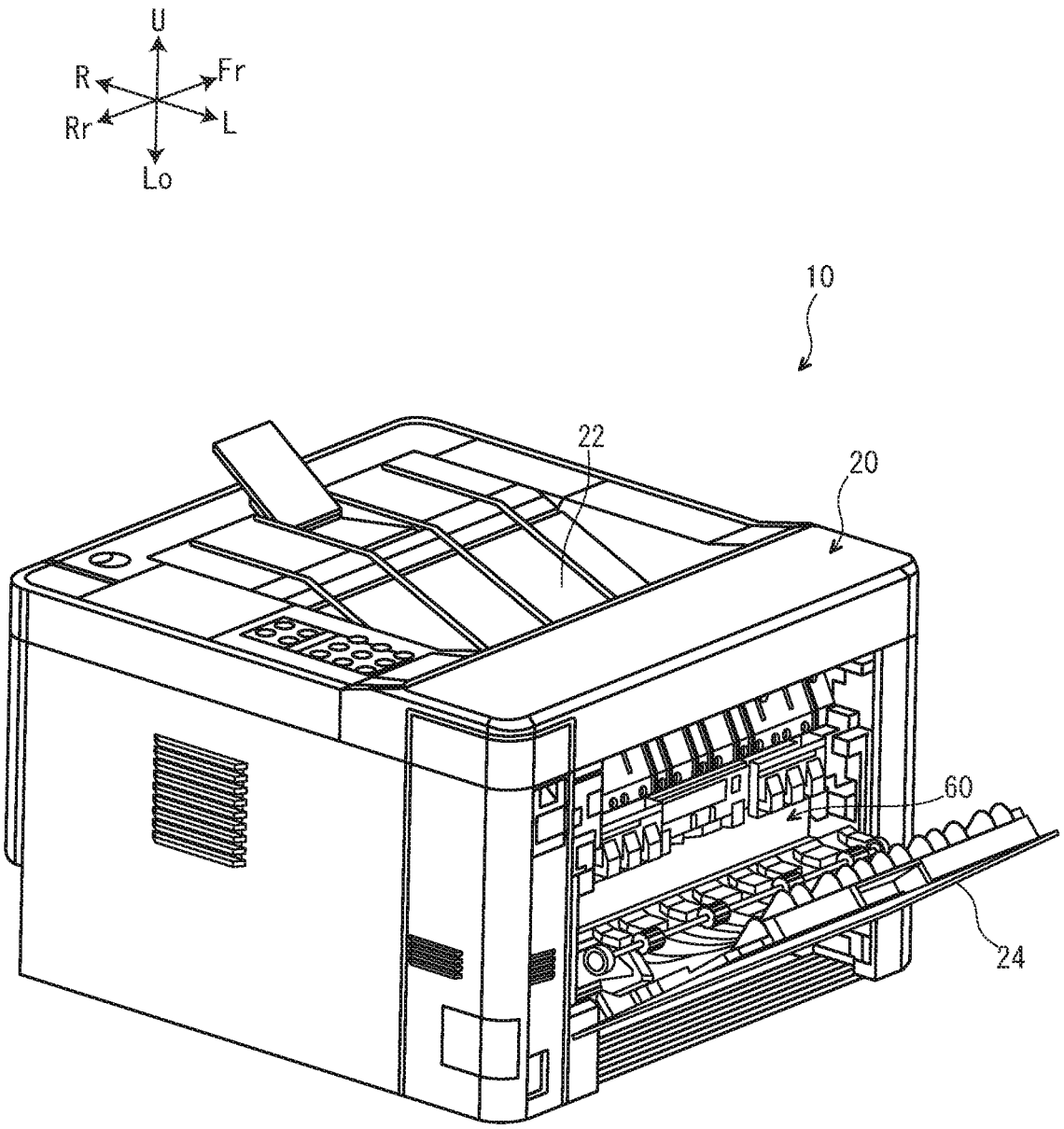
FIG. 1 is a perspective view showing an image forming apparatus according to an embodiment of the present disclosure.

Hereinafter, entire structure of an image forming apparatus 10 (refer to FIGS. 1 and 2) of an embodiment according to the present disclosure and image forming operation of the image forming apparatus 10, structure and fixing operation of a fixing device 60 (refer to FIG. 4A) as a main component of the present embodiment, and effects of the present embodiment will be described in order.

In the present specification, arrows Fr and Rr in the drawings respectively correspond to a near side and a far side in an apparatus depth direction, arrows R and L in the drawings respectively correspond to a right side and a left side in an apparatus width direction, and arrows U and Lo in the drawings respectively correspond to an upper side and a lower side in an apparatus height direction. The specification will be described so that a state of the image forming apparatus 10 as viewed from the near side in the apparatus depth direction is estimated to be a front side of the image forming apparatus 10.

Figure 2:
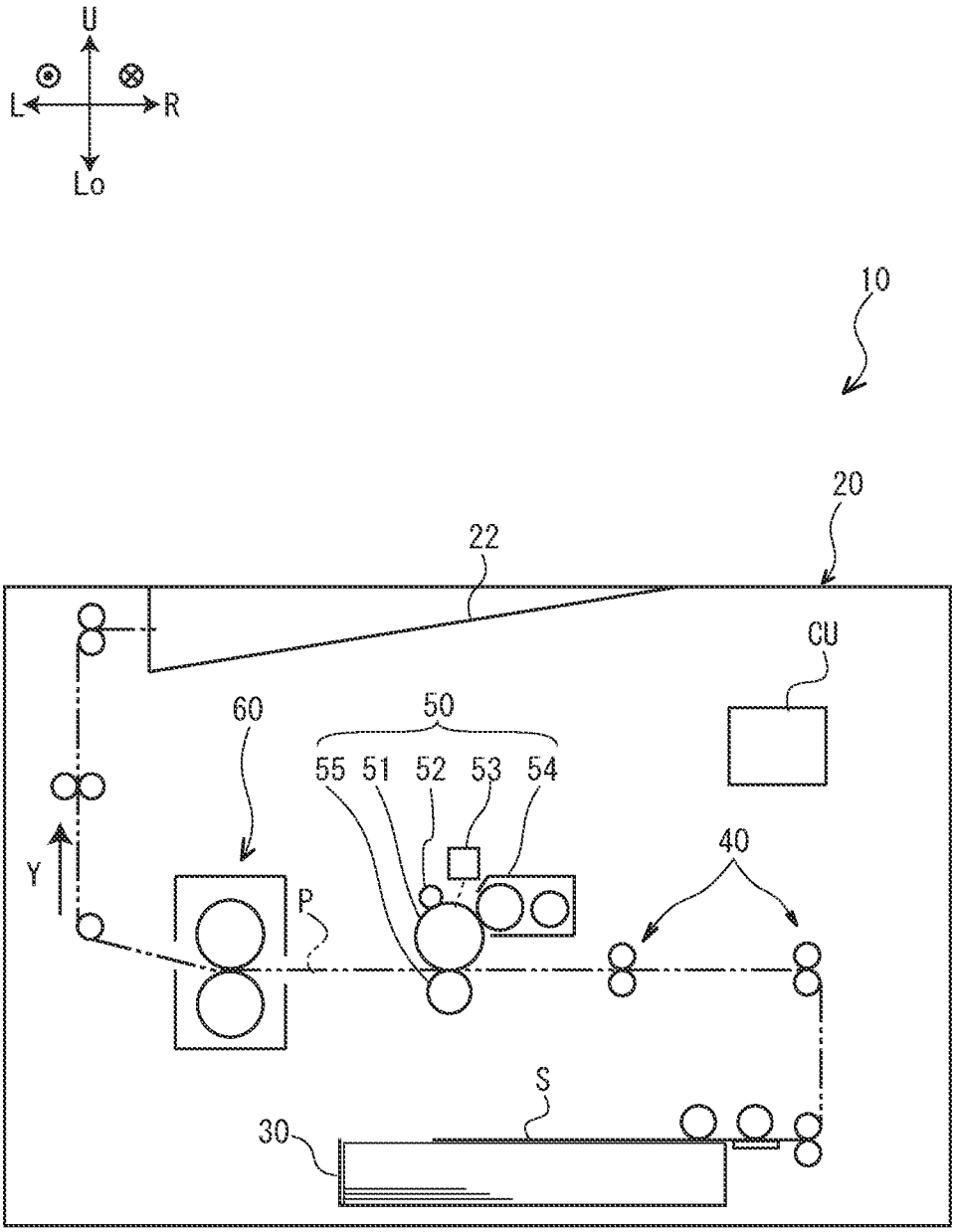
FIG. 2 is a sectional view schematically showing the image forming apparatus, as viewed from a front side, according to the present embodiment.

The entire structure of the image forming apparatus 10 will be described with reference to FIGS. 1 and 2. The image forming apparatus 10 is an electrographic type apparatus configured to include a main body 20, a sheet feeding cartridge 30, a conveying device 40, a toner image forming part 50, the fixing device 60 and controlling part CU.

The main body 20 has a function housing the sheet feeding cartridge 30, the conveying device 40, the toner image forming part 50, the fixing device 60 and controlling part CU in its inside. The main body 20 is a box-like exterior. A part of an upper face of the main body 20 is an ejection tray 22 onto which a medium S having a fixed toner image (having a formed image) is ejected. Incidentally, in a left end face of the main body 20 as viewed from the front side, a lid part 24 is arranged. With respect to the main body 20, in a state that the lid part 24 is laid on its side (refer to FIG. 1), the fixing device 60 described later is attachable/detachable.

The sheet feeding cartridge 30 is located at a lower side in the main body 20 and stores stacked mediums S onto which an image is formed. The conveying device 40 has a function conveying the medium S stored in the sheet feeding cartridge 30 from the sheet feeding cartridge 30 to the ejection tray 22 along a conveying path P. Here, a direction indicated by arrows Y in the drawings is a conveying direction of the medium S.

The toner image forming part 50 has a function forming a toner image onto the medium S conveyed by the conveying device 40. The toner image forming part 50 is located at a center inside the main body 20 as viewed from the front side. The toner image forming part 50 is configured to include a photosensitive body 51, a charging device 52, an exposing device 53, a developing device 54 and a transferring roller 55.

The toner image forming part 50 is configured to electrically charge the photosensitive body 51 rotating around its axis by the charging device 52, to expose the photosensitive body 51 by the exposing device 53 to form a latent image, to develop the latent image to the toner image by the developing device 54, and to transfer the toner image onto the medium S by the transferring roller 55. As described above, the toner image forming part 50 forms the toner image onto the medium S. Incidentally, in the present embodiment, the average charge of a toner (not shown) forming the toner image has positive polarity. Further, the toner is composed of a binder as a main ingredient, wax included in the binder, external additives and others.

The fixing device 60 has a function fixing the toner image onto the medium S on which the toner image is transferred by the toner image forming part 50 (the medium having the formed toner image). The fixing device 60 is located at a left side inside the main body 20 as viewed from the front side. Because the fixing device 60 is a main component of the present embodiment, detail structure of the fixing device 60 will be described later.

The controlling part CU has a function receiving image data from an external device (not shown) and controlling components composing the image forming apparatus 10 on the basis of the image data. A detail function of the controlling part CU will be described in the later description of the image forming operation and the fixing operation.

Next, the image forming operation of the image forming apparatus 10 of the present embodiment will be described with reference to FIGS. 2 and 3.

First, the controlling part CU, when receiving image data from the external device (not shown), activates the toner image forming part 50. Then, the charging device 52 electrically charges the photosensitive body 51, the exposing device 53 exposes the photosensitive body 51 to form the latent image, and the developing device 54 develops the latent image to the toner image, and thereby, the toner image is formed on the photosensitive body 51.

Moreover, the controlling part CU activates the conveying device 40 to send the medium S to a transferring position in accordance with a timing when the toner image formed on the photosensitive body 51 reaches at the transferring position (a part where the photosensitive body 51 and the transferring roller 55 come into contact with each other) by rotation of the photosensitive body 51 around the axis. Then, the transferring roller 55 transfers the toner image formed on the photosensitive body 51 to the medium S to form the toner image onto the mediums.

Subsequently, the controlling part CU activates the fixing device 60 to fix the toner image transferred on the medium S by the transferring roller 55 onto the medium S. Subsequently, the medium S having the fixed toner image, i.e., the medium S having the formed image is conveyed to a further downstream side in the conveying direction by the conveying device 40 and ejected onto the ejection tray 22 of the man body 20, and then, the image forming operation is completed.

Next, the structure of the fixing device 60 as the main component of the present embodiment will be described in detail with reference to FIGS. 4A-4C (mainly, FIG. 4A).

The fixing device 60 of the present embodiment is configured to include a heating roller 61 (one example of a heating body), a pressuring roller 62 (one example of a pressuring body), a heating source 63, a separation claw 64, a temperature sensor (not shown), a first corona charging device 70 (one example of a charging part), a second corona charging device 80 (one example of a collecting part), a power source PS, an ammeter 90 (one example of a sensing part), a housing HG, and a pair of side plates (not shown).

The heating roller 61, the pressuring roller 62, the heating source 63, the first corona charging device 70 and the second corona charging device 80 have respective longitudinal sizes and are positioned to the pair of lateral plates in a state that respective longitudinal directions are parallel to each other (to the apparatus depth direction). Moreover, the fixing device 60 has a longitudinal size and is attached to the main body 20 of the image forming apparatus 10 in a state that its longitudinal direction is parallel to the apparatus depth direction (refer to FIG. 1). Incidentally, the housing HG houses parts (e.g., the heating roller 61 and the pressing roller 62) of components composing the fixing device 60 in the inside thereof.

The heating roller 61 has functions coming into contact with the medium S while rotating, and heating the medium S and the toner image (the toner forming it) formed on the medium S by the toner image forming part 50. The heating roller 61 is, as one example, a roller of multi-layer structure composed of a cylindrical aluminum tube stock 61A, a surface layer 61B and a primer layer 61C. The surface layer 61B covers an outer circumference of the aluminum tube stock 61A. The primer layer 61C is sandwiched between the aluminum tube stock 61A and the surface layer 61B, thereby bonding the aluminum tube stock 61A and the surface layer 61B. The aluminum tube stock 61A is grounded via a casing (not shown) of a device body. In the present embodiment, the surface layer 61B is, as an example, made of a PFA tube. Incidentally, The PFA tube has properties easily charged with negative polarity by contact with the medium S. Thus, when the toner (the toner of which the average charge has positive polarity) of the present embodiment is used, there is a tendency that the toner formed on the medium S is adhered to the heating roller 61 to cause electrostatic offset.

The heating roller 61 is driven by following the pressing roller 62 described later to rotate on its axis, while receiving heat from the heating source 63 described later. Here, in FIG. 4A, reference code O in FIG. 3 indicates a rotation center of the heating roller 61 and an arrow A indicates a rotating direction of the heating roller 61. Moreover, the heating roller 61 pressures the medium S having the formed toner image conveyed by the conveying device 40, in cooperation with the pressuring roller 62 at a nip N described later. As a result, the heating roller 61 comes into contact with the medium S having the formed toner image while rotating around its axis, heats the medium S, and pressures the medium S passing through the nip N in cooperation with the pressuring roller 62, and thereby, fixes the toner image onto the medium S.

In parts at both ends of the heating roller 61, flanges (not shown) are fitted and the heating roller 61 is glued and fixed to each flange. Moreover, the respective flanges are rotatably supported, via a shaft (not shown) fitted to them, to the pair of side plates.

The pressuring roller 62 has a function pressuring the toner image (the toner forming it) formed on the medium S by the toner image forming part 50 and the medium S in cooperation with the heating roller 61. The pressuring roller 62 is a roller composed of an elongated shaft and a covering layer covering an outer circumference of the shaft. The pressuring roller 62 is located at a lower side of the heating roller 61 as viewed in the apparatus depth direction. Moreover, an upper side portion of the pressuring roller 62 comes into contact with a lower side portion of the heating roller 61. Then, the above-described nip N indicates a contact section formed by the pressing roller 62 and the heating roller 61 and disposed between the pressing roller 62 and the heating roller 61.

To one end of the shaft of the pressing roller 62, a driving source (not shown) is connected. Then, the pressing roller 62 is driven by the driving source to rotate on its axis, and then, makes the heating roller 61 rotate. Here, an arrow B in FIG. 4A indicates a rotating direction of the pressing roller 62.

The heating source 63 has a function supplying the heating roller 61 with heat used for heating the medium S by the heating roller 61. The heating source 63 is configured, as one example, to include an induction coil 63A and an alternating-current power source 63B. The induction coil 63A is positioned to face to an outer circumference corresponding to an upper half of the heating roller 61 over an upper side of the heating roller 61. That is, the induction coil 63A is formed in an arc shape as viewed from the front side. When an alternating-current voltage is applied from the alternating-current power source 63B, the induction coil 63A heats the heating roller 61 by the action of electromagnetic induction.

The separation claw 64 has a function separating, i.e., detaching, the medium S passed the nip N from the heating roller 61. The separation claw 64 is positioned near to the nip N at a downstream side with respect to the nip N on the heating roller 61 and at an upstream side with respect to a position on the heating roller 61 facing to the induction coil 63A in the rotating direction of the heating roller 61.

The temperature sensor (not shown) has a function sensing the temperature of the heating roller 61. The temperature sensor is, as one example, positioned to face to the outer circumference of the heating roller 61. The temperature (data on the temperature) sensed by the temperature sensor is transmitted to the controlling part CU at a predetermined cycle.

Figure 4A:
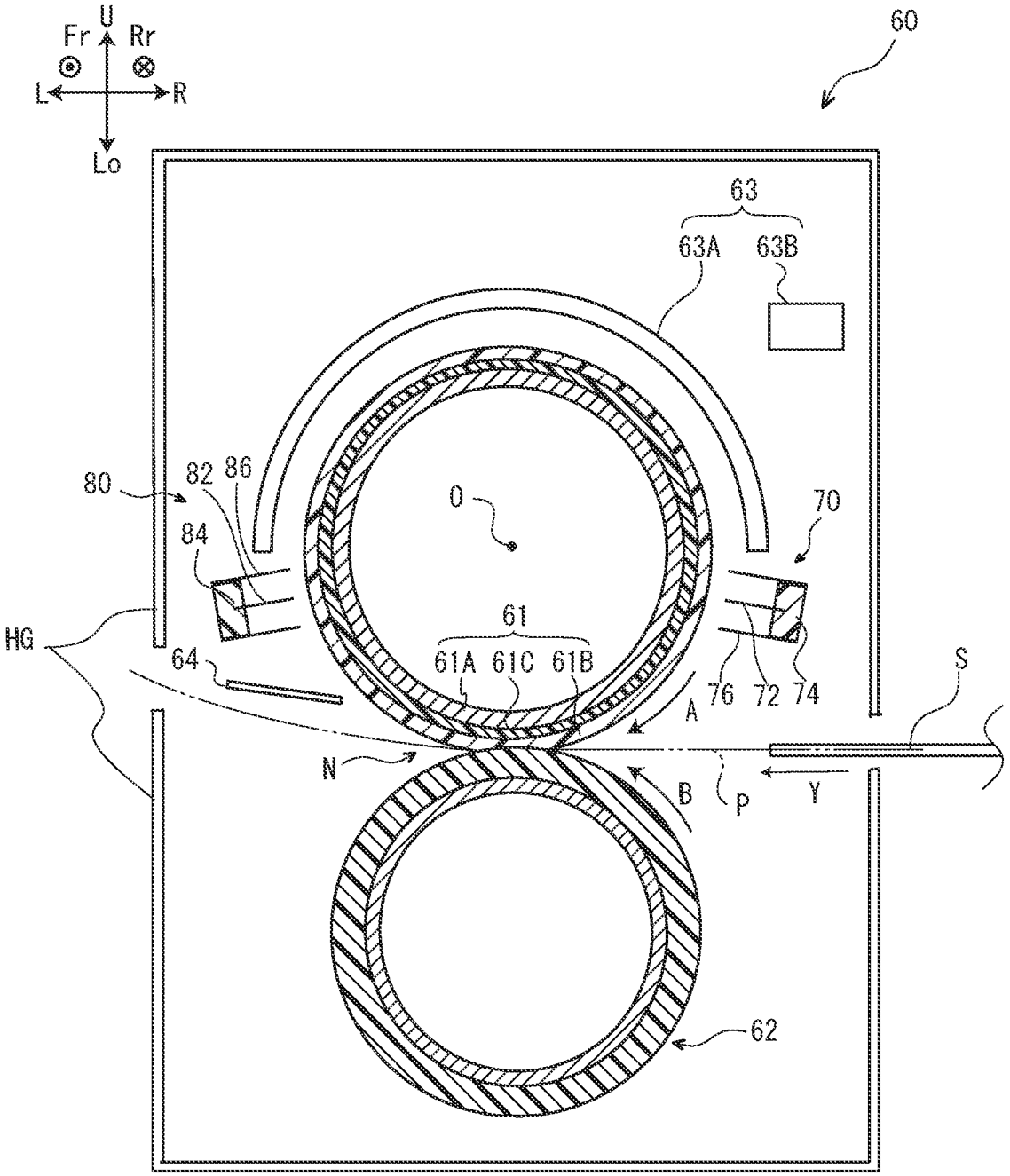
FIG. 4A is a transverse sectional view schematically showing the fixing device composing the image forming apparatus, as viewed from the front side, according to the present embodiment.

The first corona charging device 70 is, as shown in FIG. 4A, positioned to face to a facing a section at the downstream side with respect to the position on the heating roller 61 facing to the induction coil 63A on the heating roller 61 and at the upstream side with respect to the nip N on the heating roller 61 in the rotating direction of the heating roller 61. Moreover, the first corona charging device 70 has a function electrically discharging to electrically charge the heating roller 61 (the surface layer 61B) with the same polarity as that of the toner (the average charge of the toner), i.e., with positive polarity, in order to restrain occurrence of electrostatic offset on the heating roller 61.

The first corona charging device 70 is configured, as shown in FIG. 4A, to include a discharging electrode 72, a holding member 74 and a shield 76. The discharging electrode 72 is, as shown in FIG. 4B, as one example, an elongated metallic plate and a member having a serrated shape at one end side in its lateral direction. The holding member 74 is an elongated insulating member and supports the discharging electrode 72 by sandwiching a section at an opposite side to a side of the serrated shape of the discharging electrode 72 at one end side in its lateral direction. The shield 76 is an elongated metallic case and one end side in its lateral direction is opened. The shield 76 generates an electric field in cooperation with the discharging electrode 72. Moreover, inside the shield 76, the holding member 74 is fixed. Then, the first corona charging device 70 is configured, in a state that the discharging electrode 72 is connected to an output terminal of the power source (not shown) and the shield 76 is connected to a ground terminal, to electrically discharge ions with positive polarity when a direct-current voltage with positive polarity is applied to the output terminal. As a result, the first corona charging device 70 electrically charges the heating roller 61 with positive polarity.

Figure 4B:
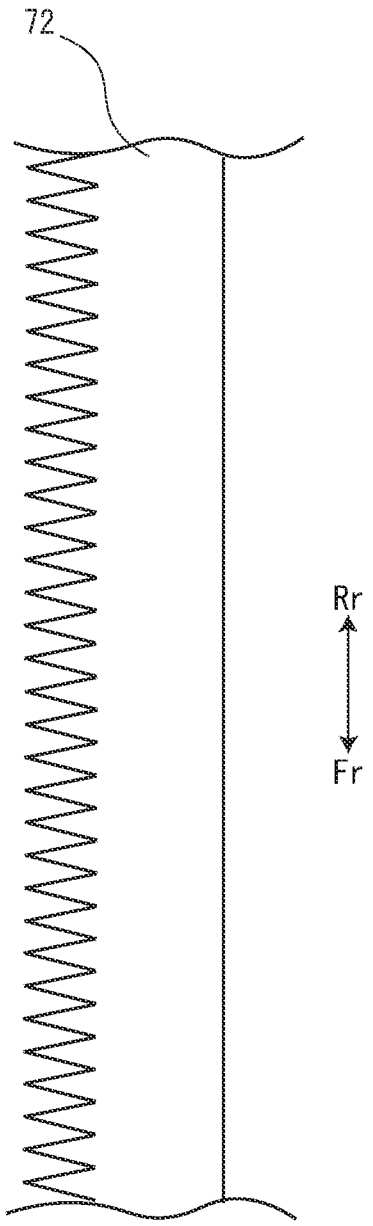
FIG. 4B is a schematic view showing a part of a discharging electrode of a first corona charging device composing the fixing device according to the present embodiment.
Figure 4C:
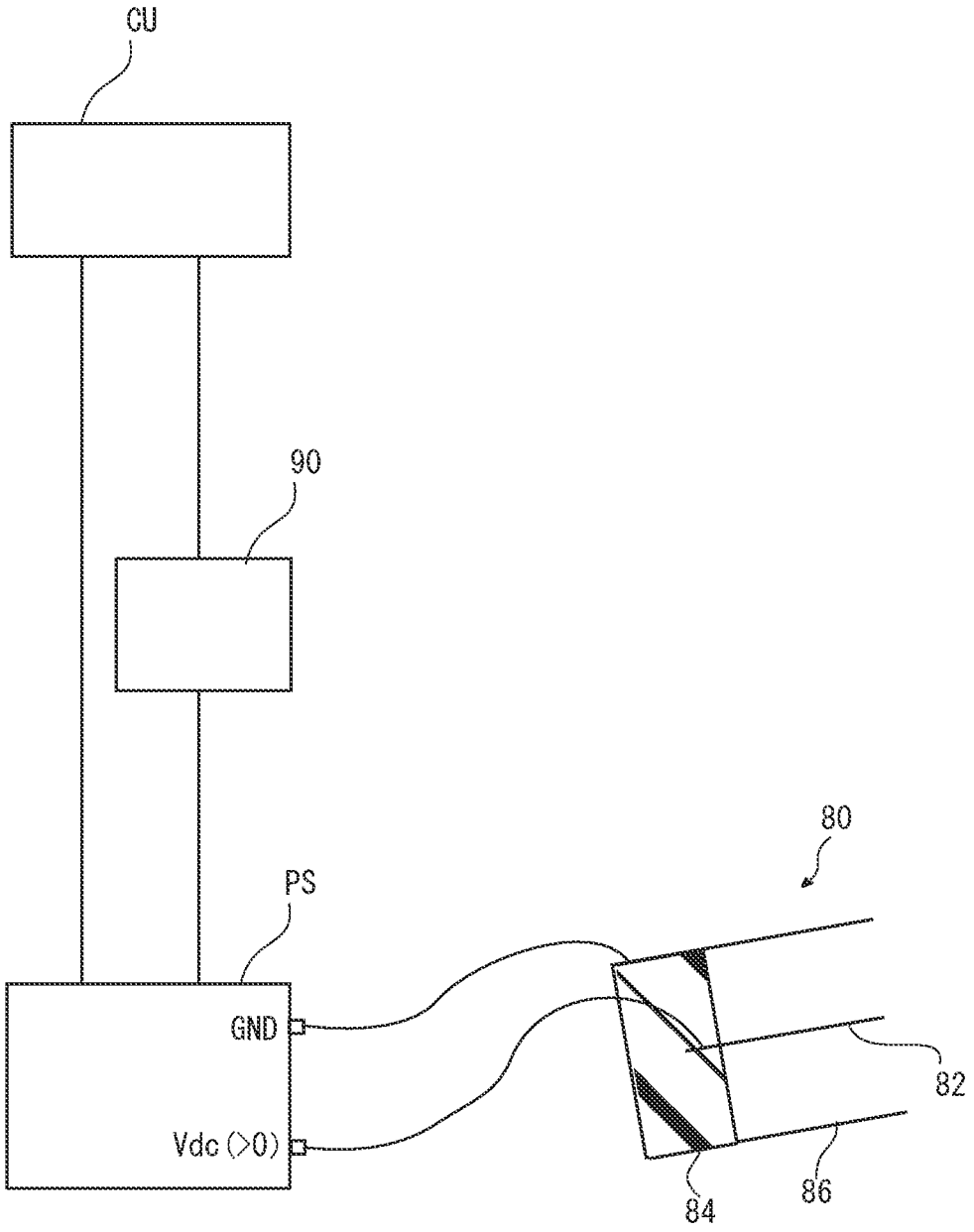
FIG. 4C is a schematic view showing a relationship of a second corona charging device, a power source, an ammeter and a controlling part composing the fixing device according to the present embodiment.

The second corona charging device 80 is, as shown in FIGS. 4A and 4C, positioned to face to a section at the upstream side with respect to the position (facing position) on the heating roller 61 facing to the induction coil 63A and at the downstream side with respect to a position (facing position) on the heating roller 61 facing to the separation claw 64 in the rotating direction of the heating roller 61. That is, the second corona charging device 80 is positioned to face to a position at the upstream side with respect to the facing position on the heating roller 61 facing to the first corona charging device 70 and at the downstream side with respect to the position (forming position) of the nip N on the heating roller 61 in the rotating direction of the heating roller 61. The second corona charging device 80 has functions absorbing and collecting impurities caused by the medium S when the medium S having the formed toner image passes through the nip N. Here, the words "impurities caused by the medium S" mean impurities that would not be generated if the toner, materials (e.g., wax) constituting the toner, gases generated from those, the medium S or the like did not pass the nip N.

The second corona charging device 80 is, as shown in FIGS. 4A and 4C, configured to include a discharging electrode 82, a holding member 84 and a shield 86 (one example of an auxiliary electrode). The second corona charging device 80 of the present embodiment has the same structure as that of the above-described first corona charging device 70. Then, the second corona charging device 80 is configured, in a state where the discharging electrode 82 is connected to an output terminal of the power source PS (refer to FIG. 4C) and the shield 86 is connected to a ground terminal of the power source PS, to electrically discharge ions with positive polarity when a direct-current voltage (Vdc in FIG. 4C) with positive polarity is applied to the output terminal of the power source PS (when a voltage is applied between the discharging electrode 82 and the shield 86 by the power source PS). As a result, (it is assumed that) the second corona charging device 80 makes corona ions with positive polarity adhere to the impurities caused by the medium S and collects the impurities with the adhered corona ions by the discharging electrode 82. Further, (it is assumed that) the impurities caused by the medium S is floated, and then, adhered to the discharging electrode 82 electrically charged with positive polarity, thereby being collected. In any mechanism, the second corona charging device 80 of the present embodiment applies the voltage with the same polarity as that of the toner (the average charge of the toner) to the discharging electrode 82 with respect to the shield 86 by the power source PS to make the discharging electrode 82 electrically discharge and to make the discharging electrode 82 electrostatically absorb the impurities.

The ammeter 90 has a function detecting a current generated when the second corona charging device 80 electrically discharges, i.e., a current flowing between the discharging electrode 82 and the shield 86. The ammeter 90 is, as shown in FIG. 4C, connected to the power source PS and the controlling part CU. The ammeter 90 detects the current flowing between the discharging electrode 82 and the shield 86 in the fixing operation at a predetermined cycle and transmits the detected current (data on the current) to the controlling part CU at each detection. Incidentally, process on the basis of the detected current will be described in the following explanation of the fixing operation of the fixing device 60.

Next, the fixing operation of the fixing device 60 will be described with reference to FIGS. 3, 4A, 4C and 5.

Figure 3:
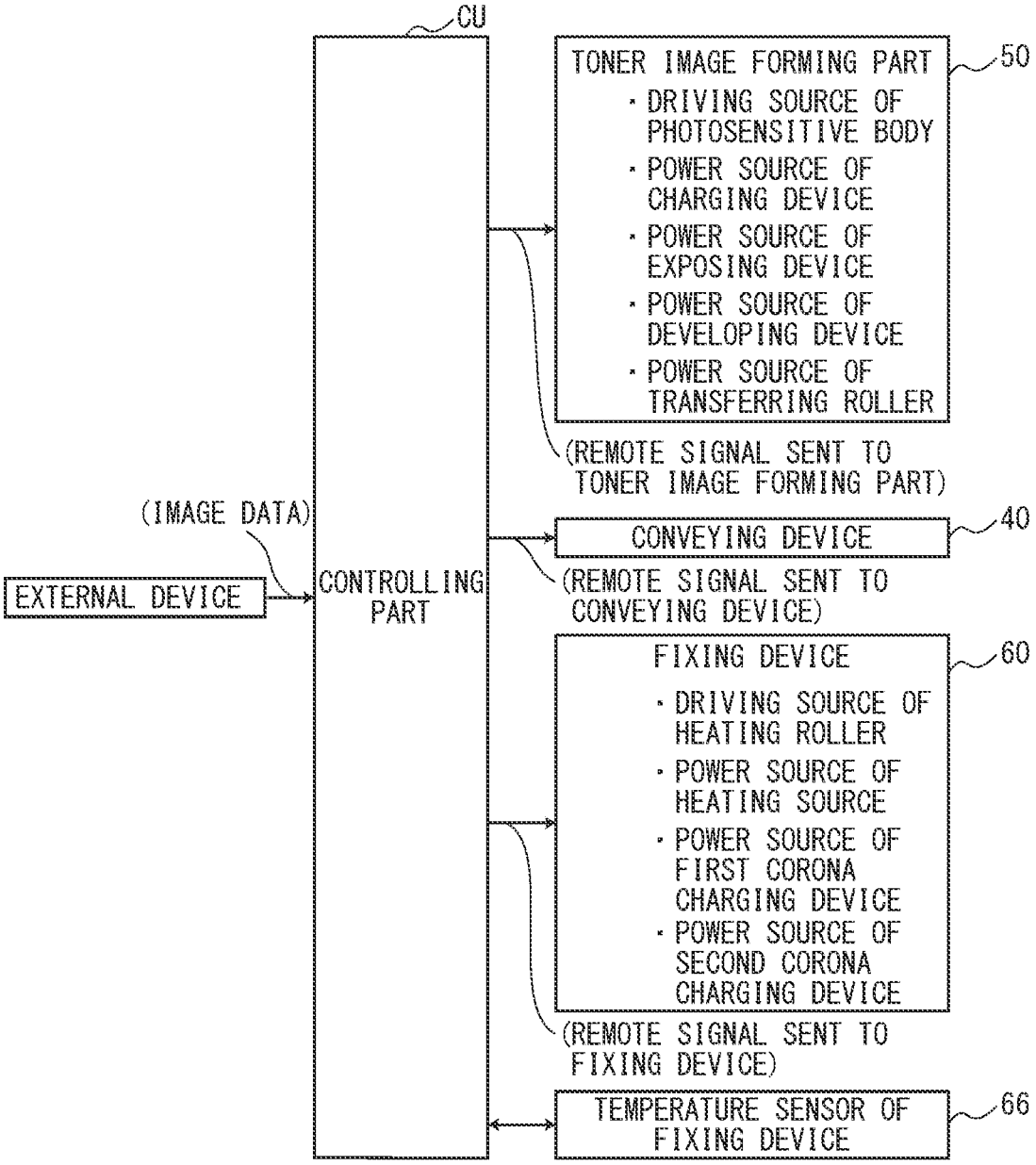
FIG. 3 is a block diagram showing a relationship of a controlling part composing the image forming apparatus according to the present embodiment and components composing a fixing device.

First, the controlling part CU, when receiving the image data from the external device (not shown), transmits a remote signal for carrying out the fixing operation to the fixing device 60 (refer to FIG. 3). Moreover, the controlling part CU drives the driving source (not shown) of the pressing roller 62 to make the pressing roller 62 rotate. According to this, the heating roller 61 is rotated by following the pressing roller 62. Further, the controlling part CU activates the alternating-current power source 63B of the heating source 63 to apply an alternating-current voltage from the alternating-current power source 63B to the induction coil 63A. According to this, the heating roller 61 is heated by the action of electromagnetic induction of the induction coil 63A.

Subsequently, the controlling part CU makes the power source PS apply a predetermined direct-current voltage with positive polarity to the discharging electrode 82 of the second corona charging device 80. Moreover, the ammeter 90 detects a current flowing between the discharging electrode 82 and the shield 86 and transmits data on the current detected at a predetermined cycle to the controlling part CU. Then, when the controlling part CU decides on the basis of the data transmitted from the ammeter 90 that a current equal to or more than a predetermined reference value flows, the controlling part CU activates the second corona charging device 80.

When all of the mediums S on which the toner image is formed by the toner image forming part 50 passes through the nip N, the controlling part CU stops the driving source of the pressing roller 62, the alternating-current power source 63B of the heating source 63, the power source of the first corona charging device 70, and the power source PS of the second corona charging device 80 and the fixing operation is completed.

Incidentally, a control flow of the controlling part CU regarding the data on the current transmitted from the ammeter 90 and the operation of the second corona charging device 80 is represented in the following.

Figure 5:
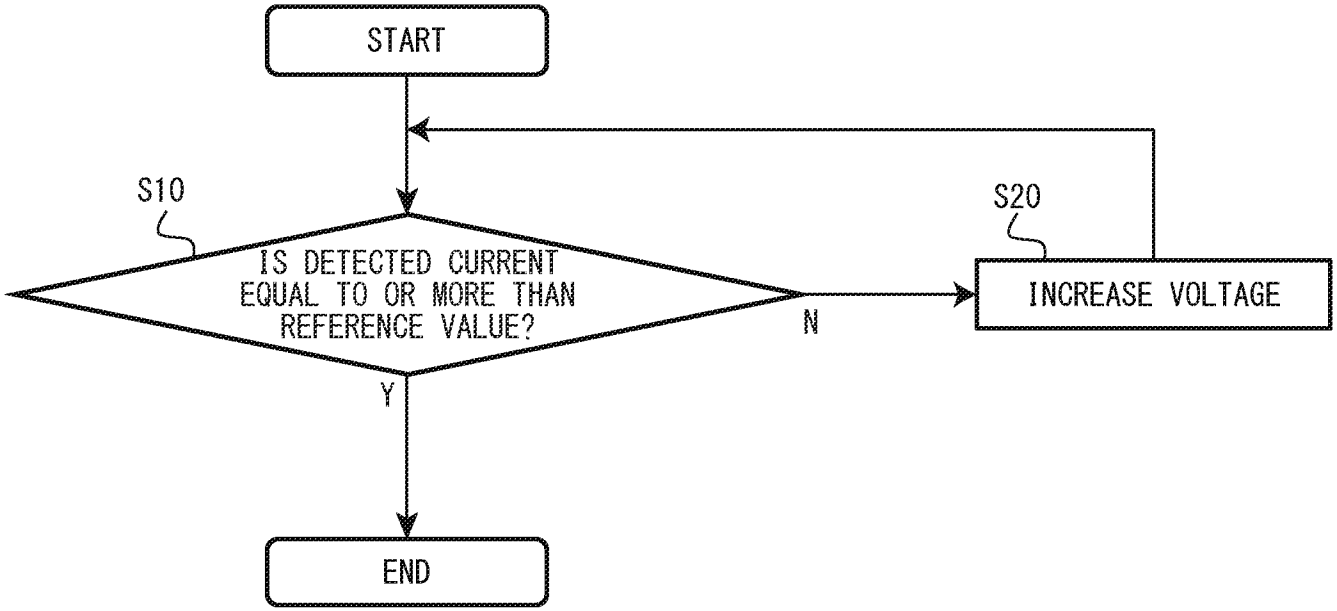
FIG. 5 is a flowchart showing a control flow for determining a voltage application condition with respect to the second corona charging device in the fixing device according to the present embodiment.

That is, as shown in FIG. 5, the controlling part CU first decides at a decision step S10 whether or not the current (data on the current) detected by the ammeter 90 is equal to or more than a predetermined reference value after the fixing operation is started. Specifically, with respect to a current flowed when a predetermined direct-current voltage (e.g., 5 kV) is applied from the power source PS to the discharging electrode 82, an actually detected current is compared with a reference current (e.g., 50 mA). As a result, if the decision step S10 results in positive, the controlling part CU completes the control flow and makes the fixing device 60 (the second corona charging device 80) perform the fixing operation (discharging operation) without changing settings.

In contrast, if the decision step S10 results in negative, the controlling part CU increases the direct-current voltage applied to the discharging electrode 82 by a predetermined amount at step S20 (for example, when the predetermined amount is set to 50 V, the corresponding direct-current voltage is set to 5050 V) and carries out the decision step S10 again. Then, the controlling part CU executes the decision step S10 and the step S20 as a subroutine, decides in positive at the decision step S10, and completes the control flow.

Next, effects of the present embodiment will be described with reference to FIGS. 4A to 4C and 5.

For example, in a case of a fixing device (not shown) having the same structure as that of the present embodiment except for the second corona charging device 80 and the power source PS (hereinafter in a case of a comparative example), when the medium S having the formed toner image passes the nip N, impurities caused by the medium S may be adhered to the discharging electrode 72 of the first corona charging device 70. As a result, it is feared that electrical discharge with respect to the heating roller 61 (in the axial direction) by the first corona charging device 70 becomes non-uniformity, and then, a discharging state is destabilized on a long-term basis. Further, this may lead to fixing failure.

In contrast, the fixing device 60 of the present embodiment includes the second corona charging device 80 absorbing and collecting impurities caused by the medium S. Thus, in a case of the present embodiment, impurities caused by the medium S are hard to float in the housing HG and to reach the first corona charging device 70 in comparison with the case of the comparative example. As a result, in the case of the present embodiment, as a first effect, impurities caused by the medium S are hard to be adhered to the discharging electrode 72 of the first corona charging device 70 in comparison with the case of the comparative example.

Consequently, the fixing device 60 of the present embodiment can stabilize the discharge state (the uniformity of electric discharge in the longitudinal direction of the discharging electrode 72) of the first corona charging device 70 for a long period of time in accordance with the first effect in comparison with the fixing device of the comparative example. The image forming apparatus 10 of the present embodiment can restrain image forming failure caused by the destabilization of the discharge state of the first corona charging device 70 in accordance with the first effect.

In particular, the above-described effect is effective in a case where the toner includes wax in consideration of the fact that the wax is evaporated and floated in the housing HG. Further, as the present embodiment, when the heating source 63 is located to face the heating roller 61 so as to cover the heating roller 61, since impurities caused by the medium S is easily moved along the gap between the induction coil 63A and the rotating heating roller 61, further effectiveness is achieved.

Figure 9:
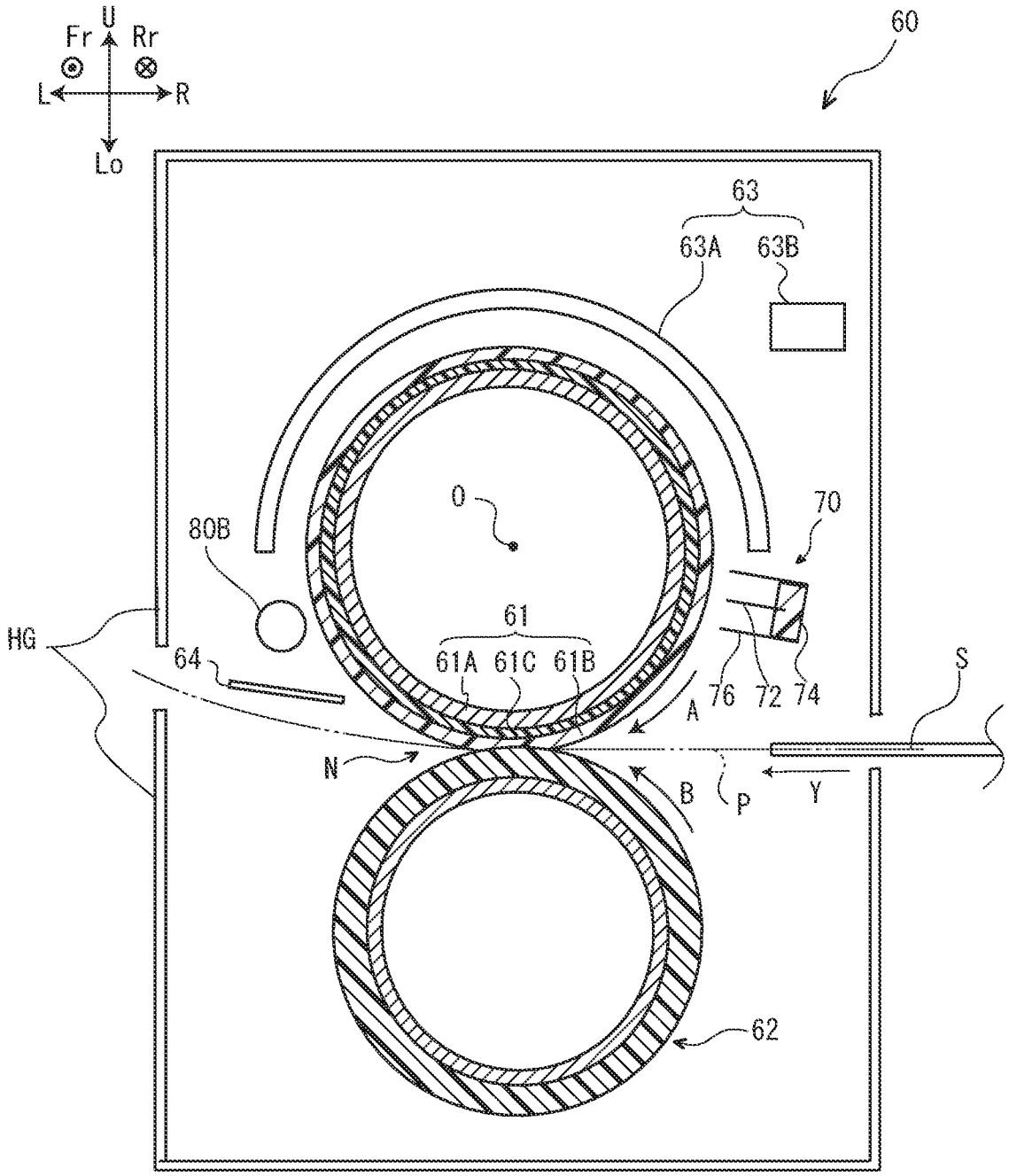
FIG. 9 is a transverse sectional view schematically showing the fixing device composing the image forming apparatus, as viewed from the front side, of a fourth modified example.

As described in the above-described first effect, in the present embodiment, the second corona charging device 80 collects impurities caused by the medium S, thereby reducing the amount of impurities reaching the first corona charging device 70. Thus, in place of the second corona charging device 80, if a member absorbing (physically absorbing and chemically absorbing are included) impurities caused by the medium S (e.g. refer to an absorbing member 80B in the fourth modified example in FIG. 9 described later) is provided, the first effect may be achieved.

However, in the present embodiment, as a second effect, impurities are not merely absorbed, but electrostatically absorbed by using the second corona charging device 80. Thus, the second corona charging device 80 achieves greater absorption amount of impurities than the member collecting the impurities caused by the medium S by physically absorbing or chemically absorbing (refer to the absorbing member 80B in the fourth modified example in FIG. 9).

Consequently, the fixing device 60 of the present embodiment can stabilize, in accordance with the second effect, the discharge state (the uniformity of electric discharge in the longitudinal direction of the discharging electrode 72) of the first corona charging device 70 for a period of time longer than a case where the impurities caused by the medium S are physically or chemically absorbed and collected. Incidentally, because the fourth modified example described later is configured to have the first effect, it is included within the technical scope of the present disclosure.

In addition, the fixing device 60 of the present embodiment includes, as shown in FIG. 4C, the ammeter 90 detecting a current flowed when the discharging electrode 82 electrically discharges. The ammeter 90 is connected to the power source PS and the controlling part CU to detect the current flowed between the discharging electrode 82 and the shield 86 at a predetermined cycle and transmits the detected current (data on the current) to the controlling part CU at each detection. Then, when the current detected by the ammeter 90 is less than a predetermined reference value, the controlling part CU makes the power source PS change a voltage applied to the discharging electrode 82 so that the current is equal to or more than the predetermined reference value, that is, controls so that the current detected by the ammeter 90 becomes equal to or more than the predetermined reference value (refer the control flow in FIG. 5).

In the present embodiment, when the current detected by the ammeter 90 is less than a predetermined reference value, the controlling part CU decides that the current is reduced due to an increase in electric resistance caused by adhesion of impurities to the discharging electrode 82 of the second corona charging device 80, and then, performs the above-described control.

Consequently, the fixing device 60 of the present embodiment can favorably maintain, as a third effect, collectability of impurities irrespective of quantity of impurities adhered to the discharging electrode 82 in comparison with a case where the above-described control is not performed.

As described above, although the present embodiment have been described as one example of the present disclosure, the technical scope of the present disclosure is not limited to the present embodiment. For example, the technical scope of the present disclosure includes the following configuration.

For example, the present embodiment has been described so that the controlling part CU is not component of the fixing device 60. However, a section controlling the fixing device 60 in the controller CU may be configured as a part of the fixing device 60.

Moreover, the present embodiment has been described so that the as one example of the heating body is the heating roller 61 and one example of the pressing body is the pressing roller 62. However, one example of the heating body is limited to the heating roller 61 and any member may be used for the heating body as long as it has a function heating the medium S while rotating. For example, one example of the heating body may be an endless belt. Further, one example of the pressing body is limited to the pressing roller 62 and any member may be used for the pressing body as long as it has a function forming the nip N in cooperation with the heating body while rotating, and pressing the medium S passing through the nip N in cooperation with the heating body. For example, one example of the pressing body may be an endless belt.

Further, the present embodiment has been described so that the average charge of the toner has positive polarity. However, the average charge of the toner may have negative polarity. In this case, to the discharging electrode 72 of the first corona charging device 70, a voltage having negative polarity as the same polarity as that of the toner may be applied.

Furthermore, the present embodiment has been described so that the discharging electrode 72 of the first corona charging device 70 and the discharging electrode 82 of the second corona charging device 80 are the serrated shaped members (refer to FIG. 4B). However, the discharging electrode 72 and the discharging electrode 82 are not limited to the serrated shaped members and any members may be used for the discharging electrode 72 and the discharging electrode 82 as long as they have a function electrically discharging. For example, the discharging electrode 72 and the discharging electrode 82 may be a merely elongated planar member, a wire member or a member formed of a plurality of needle electrodes aligned in a row (not shown).

Figure 6:
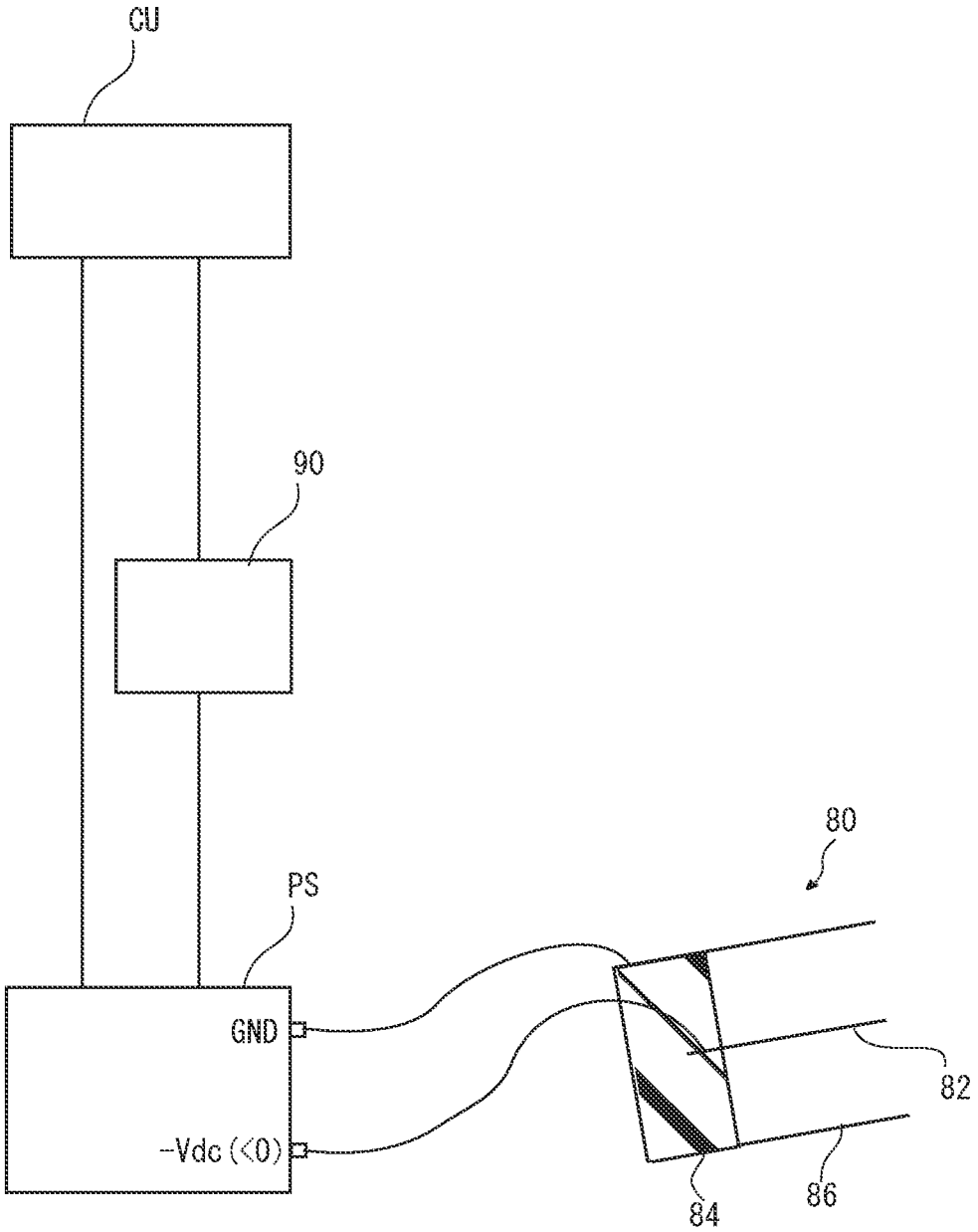
FIG. 6 is a schematic view showing a relationship of the second corona charging device, the power source, the ammeter and the controlling part composing the fixing device of a first modified example.
Figure 8:
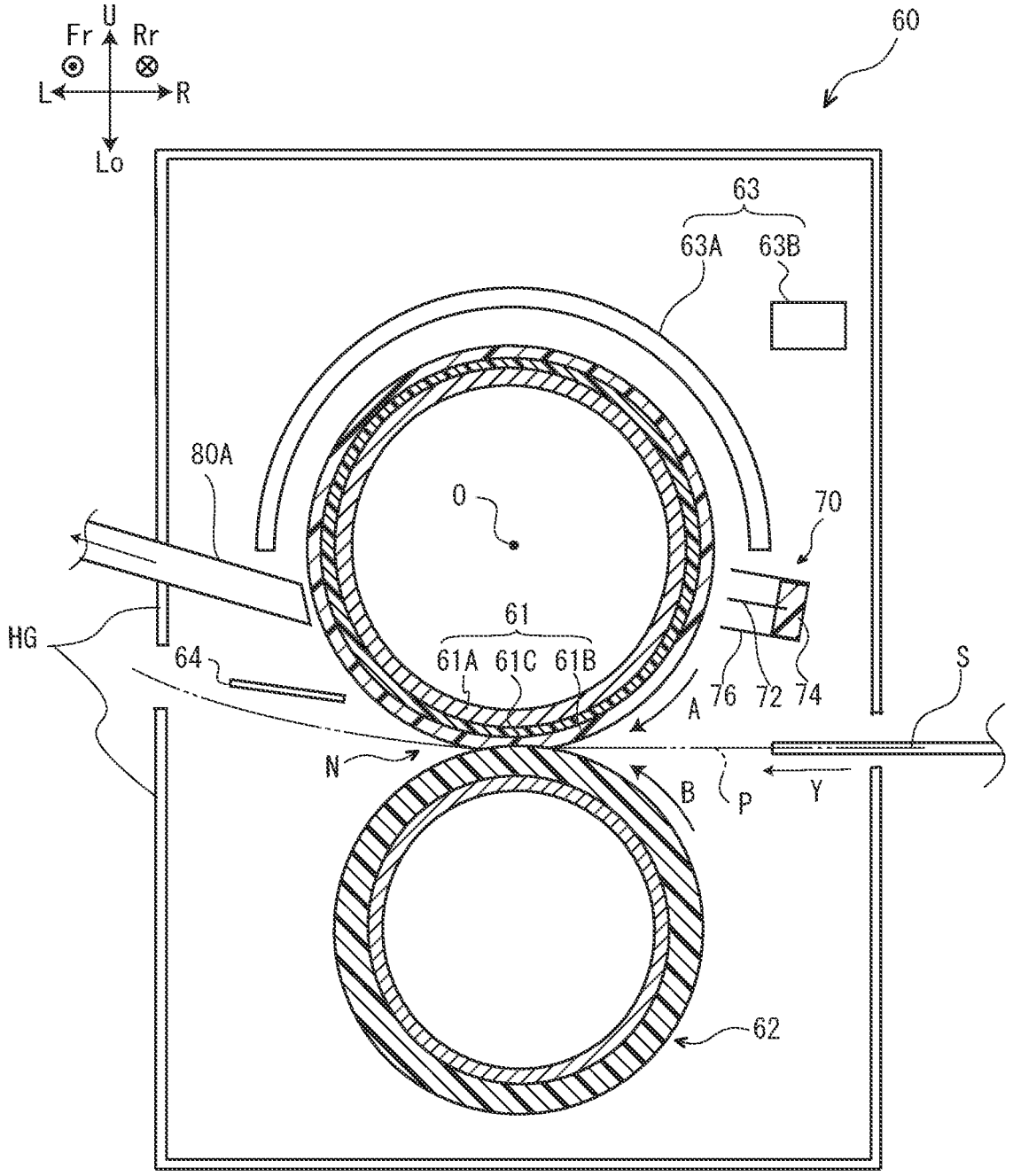
FIG. 8 is a transverse sectional view schematically showing the fixing device composing the image forming apparatus, as viewed from the front side, of a third modified example.

Moreover, the present embodiment has been described so that a direct-current voltage (Vdc in FIG. 4C) with positive polarity is applied to the discharging electrode 82 of the second corona charging device 80. In addition, it is described so that the application of the voltage to the discharging electrode 82 enables the discharging electrode 82 to electrostatically absorb the impurities caused by the medium S. However, as in the first modified example in FIG. 6, a direct-current voltage (refer to −Vdc in FIG. 8) (voltage with opposite polarity to polarity of the toner) with negative polarity may be applied to the discharging electrode 82. In a case of the first modified example, which is different from the present embodiment, other impurities having opposite polarity to that of the impurities adhered to the discharging electrode 82 in the present embodiment are easily electrostatically absorbed by the discharging electrode 82.

Figure 7:
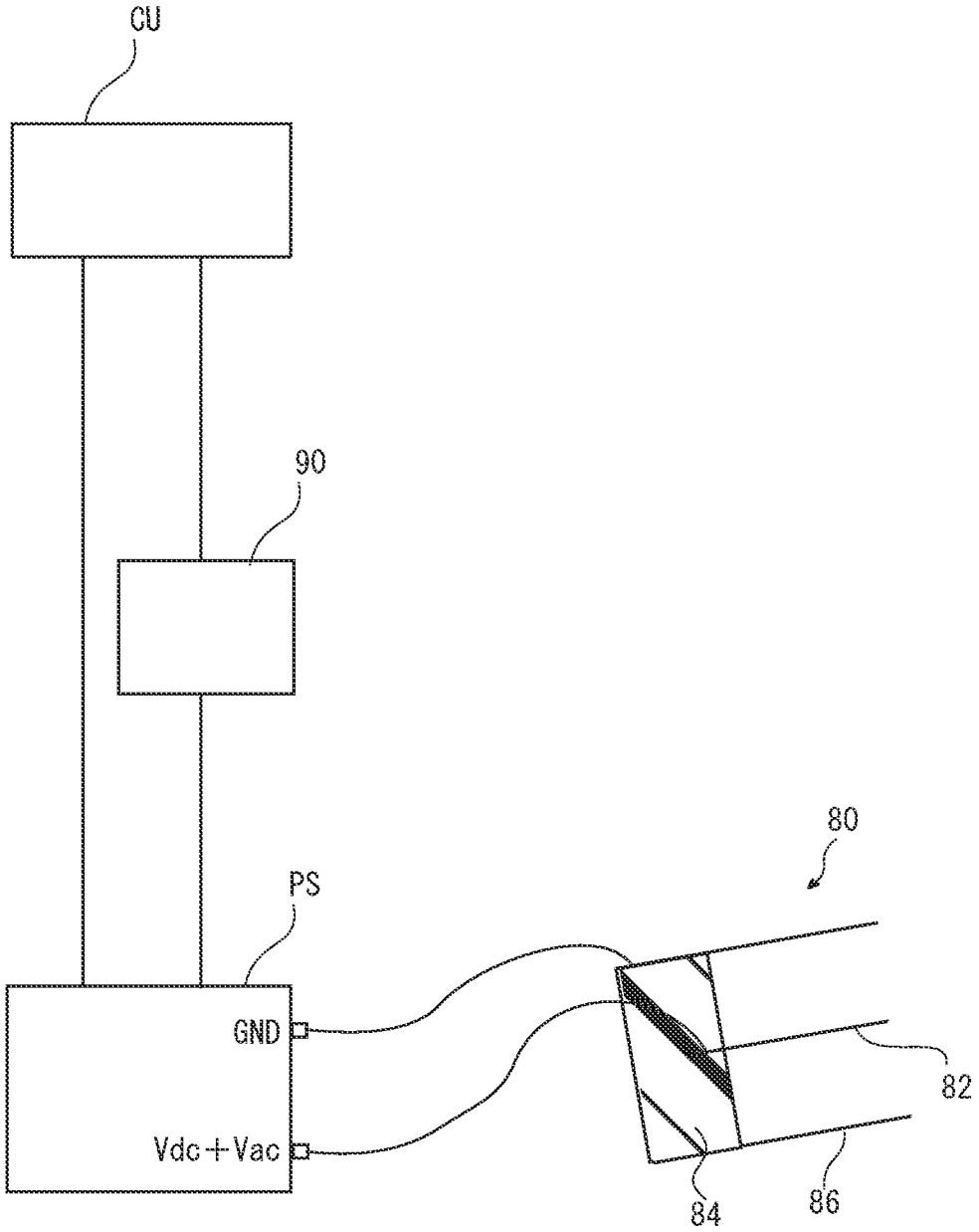
FIG. 7 is a schematic view showing a relationship of the second corona charging device, the power source, the ammeter and the controlling part composing the fixing device of a second modified example.

The present embodiment and the first modified example has been described so that a direct-current voltage is applied to the discharging electrode 82. However, as in a second modified example in FIG. 7, a voltage in which an alternating-current voltage (Vac) is superimposed on the direct-current voltage (Vdc) may be applied to the discharging electrode 82. In this case, if the polarity of the discharging electrode 82 is set so as to alternately change negative polarity and positive, the second modified example achieves the same effects as those of the present embodiment and the first modified example.

Further, the present embodiment has been described so that the second corona charging device 80 electrostatically absorbing and collecting impurities is one example of a collecting part. However, the collecting part may have structure different from that of the present embodiment as long as it has a function collecting impurities caused by the medium S passing the nip N. For example, as in a third modified example in FIG. 8, in place of the second corona charging device 80, a sucking part 80A removing and collecting impurities caused by the medium S passing the nip N by sucking may be employed. In this case, the sucking part 80A is one example of the collecting part. Alternatively, as described above, as in the fourth modified example in FIG. 9, in place of the second corona charging device 80, the absorbing member 80B collecting impurities caused by the medium S passing the nip N by absorbing may be employed.

Figure 10:
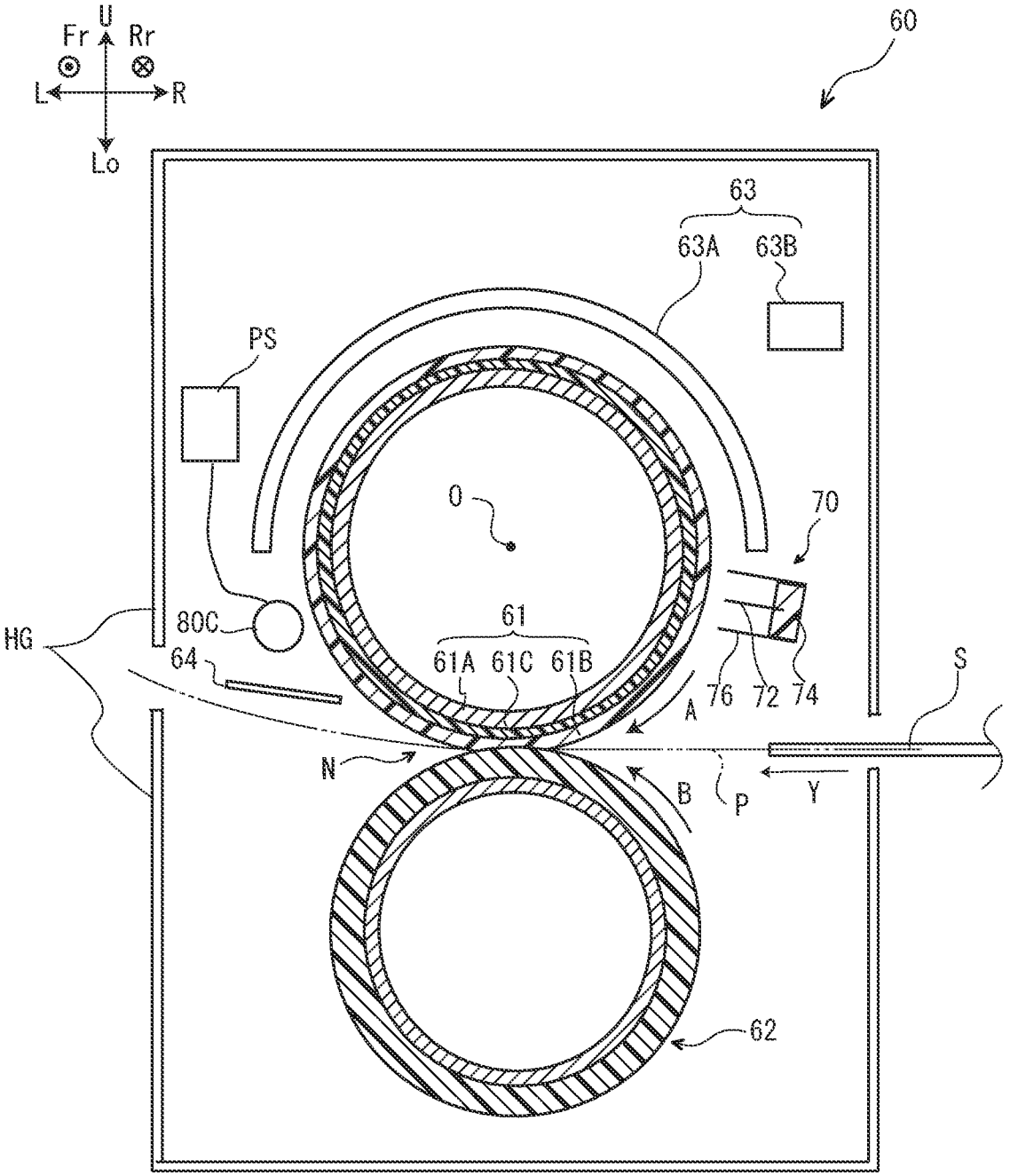
FIG. 10 is a transverse sectional view schematically showing the fixing device composing the image forming apparatus, as viewed from the front side, of a fifth modified example.

Furthermore, the present embodiment has been described so that the second corona charging device 80 electrostatically absorbing and collecting impurities is one example of a collecting part. However, the collecting part may have structure different from that of the present embodiment as long as it has a function collecting impurities caused by the medium S passing the nip N. For example, as in a fifth modified example in FIG. 10, in place of the second corona charging device 80, a member (a collection member 80C) to which a voltage is applied may be located so that the collection member 80C collects impurities caused by the medium S passing the nip N by electrostatically absorbing. In this case, any one of the direct-current voltage (Vdc) with positive polarity, the direct-current voltage (−Vdc) with negative polarity, or a voltage in which the alternating-current voltage (Vac) is superimposed on the direct-current voltage (Vdc) may be applied to the collection member 80C.

Incidentally, the above-description of the embodiments was described about one example of the fixing device and the image forming apparatus including this according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

The invention claimed is:

1. A fixing device comprising:

a heating body coming into contact with a medium, on which a toner image is formed, while rotating to heat the medium;

a pressuring body forming a nip in cooperation with the heating body while rotating to pressure the medium passing through the nip in cooperation with the heating body;

a charging part positioned to face to the heating body and electrically discharging to electrically charge the heating body with the same polarity as polarity of toner; and a collecting part positioned to face to a position at an upstream side with respect to a facing position on the heating body to the charging part and at a downstream side with respect to a forming position of the nip in a rotating direction of the heating body, and collecting impurities caused by the medium passing the nip by absorbing or removing, wherein the collecting part collects the impurities by electrostatically absorbing, the collecting part includes a discharging electrode; an auxiliary electrode generating an electric field in cooperation with the discharging electrode; and a power source applying a voltage between the discharging electrode and the auxiliary electrode in order to generate the electric field, and the power source applies a voltage with the same polarity as the polarity of the toner to the discharging electrode with respect to the auxiliary electrode to make the discharging electrode electrically discharge and to make the discharging electrode electrostatically absorb the impurities.

2. The fixing device according to claim 1, further comprising:

a detecting part detecting a current flowing between the discharging electrode and the auxiliary electrode; and a controlling part controlling, when the current detected by the detecting part is less than a predetermined reference value, the power source so that the current is equal to or more than the reference value.

3. An image forming apparatus comprising:

a forming part forming a toner image onto a medium; and the fixing device according to claim 2 fixing the toner image formed on the medium by the forming part onto the medium.

4. An image forming apparatus comprising:

a forming part forming a toner image onto a medium; and the fixing device according to claim 1 fixing the toner image formed on the medium by the forming part onto the medium.

5. A fixing device comprising:

a heating body coming into contact with a medium, on which a toner image is formed, while rotating to heat the medium;

a pressuring body forming a nip in cooperation with the heating body while rotating to pressure the medium passing through the nip in cooperation with the heating body;

a charging part positioned to face to the heating body and electrically discharging to electrically charge the heating body with the same polarity as polarity of toner; and a collecting part positioned to face to a position at an upstream side with respect to a facing position on the heating body to the charging part and at a downstream side with respect to a forming position of the nip in a rotating direction of the heating body, and collecting impurities caused by the medium passing the nip by absorbing or removing, wherein the collecting part collects the impurities by electrostatically absorbing, the collecting part includes a discharging electrode; an auxiliary electrode generating an electric field in cooperation with the discharging electrode; and a power source applying a voltage between the discharging electrode and the auxiliary electrode in order to generate the electric field, the power source applies a voltage with opposite polarity to the polarity of the toner to the discharging electrode with respect to the auxiliary electrode to make the discharging electrode electrically discharge and to make the discharging electrode electrostatically absorb the impurities.

6. An image forming apparatus comprising:

a forming part forming a toner image onto a medium; and the fixing device according to claim 5 fixing the toner image formed on the medium by the forming part onto the medium.

7. A fixing device comprising:

a heating body coming into contact with a medium, on which a toner image is formed, while rotating to heat the medium;

a pressuring body forming a nip in cooperation with the heating body while rotating to pressure the medium passing through the nip in cooperation with the heating body;

a charging part positioned to face to the heating body and electrically discharging to electrically charge the heating body with the same polarity as polarity of toner; and a collecting part positioned to face to a position at an upstream side with respect to a facing position on the heating body to the charging part and at a downstream side with respect to a forming position of the nip in a rotating direction of the heating body, and collecting impurities caused by the medium passing the nip by absorbing or removing, wherein the collecting part collects the impurities by electrostatically absorbing, the collecting part includes a discharging electrode; an auxiliary electrode generating an electric field in cooperation with the discharging electrode; and a power source applying a voltage between the discharging electrode and the auxiliary electrode in order to generate the electric field, the power source applies a voltage in which an alternating-current voltage is superimposed on a direct-current voltage to the discharging electrode with respect to the auxiliary electrode to make the discharging electrode electrically discharge and to make the discharging electrode electrostatically absorb the impurities.

8. An image forming apparatus comprising:

a forming part forming a toner image onto a medium; and the fixing device according to claim 7 fixing the toner image formed on the medium by the forming part onto the medium.

* * * * *